US008100738B2

(12) United States Patent
Tschudin

(10) Patent No.: US 8,100,738 B2
(45) Date of Patent: Jan. 24, 2012

(54) GRINDING MACHINE AND METHOD FOR GRINDING WORK PIECES BETWEEN CENTERS AND FOR CENTERLESS GRINDING IN WHICH THE WORK PIECE CAN BE SUPPORTED BETWEEN A GRINDING WHEEL, AND A REGULATING WHEEL EITHER BETWEEN CENTERS ON A WORK PIECE AXIS OR ON A REST FOR CENTERLESS GRINDING

(76) Inventor: Urs Tschudin, Grenchen (CH)

( * ) Notice: Subject to any disclaimer, the term of this patent is extended or adjusted under 35 U.S.C. 154(b) by 783 days.

(21) Appl. No.: 12/069,021

(22) Filed: Feb. 5, 2008

(65) Prior Publication Data

US 2008/0248724 A1 Oct. 9, 2008

(30) Foreign Application Priority Data

Feb. 6, 2007 (CH) ..... 0194/07

(51) Int. Cl.
*B24B 1/00* (2006.01)
*B24B 49/00* (2006.01)
*B24B 51/00* (2006.01)

(52) U.S. Cl. ..... 451/5; 451/10; 451/11; 451/49; 451/242; 451/243; 451/397

(58) Field of Classification Search ..... 451/5, 8–11, 451/49, 242, 243, 397
See application file for complete search history.

(56) References Cited

U.S. PATENT DOCUMENTS 2,322,619 A * 6/1943 Ekholm ..... 451/242
3,903,655 A 9/1975 Sommer
4,507,896 A * 4/1985 Smith ..... 451/26
5,123,213 A * 6/1992 Vinson ..... 451/245
5,558,567 A * 9/1996 Hedberg ..... 451/242
5,573,451 A * 11/1996 Tschudin ..... 451/243
5,766,057 A * 6/1998 Maack ..... 451/21
6,244,937 B1 * 6/2001 Jaskowiak et al. ..... 451/51
7,223,159 B2 * 5/2007 Tschudin et al. ..... 451/182
7,677,954 B2 * 3/2010 Hall et al. ..... 451/8
7,828,627 B2 * 11/2010 Hall et al. ..... 451/5

FOREIGN PATENT DOCUMENTS

DE 1094146 5/1961
JP 2001315044 11/2001

* cited by examiner

*Primary Examiner* — Timothy V Eley
(74) *Attorney, Agent, or Firm* — Kilpatrick Townsend & Stockton LLP

(57) ABSTRACT

A grinding machine for grinding work pieces between centers, as well as for centerless grinding, features a drive for a grinding wheel and a drive for a regulating wheel. The work piece can be supported between the grinding wheel and the regulating wheel either between centers on a work piece axis or on a rest for centerless grinding. The driving axis of the regulating wheel and the work piece axis are parallel, and the wheels can be adjusted relative to the work piece independently of one another. The drive of the regulating wheel serves for driving the work piece while grinding between centers or for driving the work piece during centerless grinding. In addition, a means for measuring the contact pressure of the regulating wheel on the work piece is provided for grinding between centers. This means may consist, for example, of a pressure sensor.

13 Claims, 3 Drawing Sheets

GRINDING MACHINE AND METHOD FOR GRINDING WORK PIECES BETWEEN CENTERS AND FOR CENTERLESS GRINDING IN WHICH THE WORK PIECE CAN BE SUPPORTED BETWEEN A GRINDING WHEEL, AND A REGULATING WHEEL EITHER BETWEEN CENTERS ON A WORK PIECE AXIS OR ON A REST FOR CENTERLESS GRINDING

CROSS-REFERENCES TO RELATED APPLICATIONS

This application claims the priority of Swiss Patent Application No. 0194/07, filed Feb. 6, 2007, the disclosure of which is incorporated herein by reference.

BACKGROUND OF THE INVENTION

The invention pertains to a grinding machine for grinding work pieces between centers and for centerless grinding, as well as to a grinding method for grinding a work piece between centers.

The invention pertains, in particular, to a grinding machine that makes it possible to combine the advantages of grinding between centers with those of centerless grinding.

In the well-known traditional method of grinding between centers, the main advantage can be seen in that all ground diameters have the same well-defined center on the work piece axis that lies between the centers. The disadvantage of this method is the higher costs caused by the need for centers. The work piece frequently needs to be processed in steps because a driving device initially needs to be attached in order to turn the work piece.

In centerless cylindrical grinding, in contrast, the work piece is merely placed on a rest between a grinding wheel and a regulating wheel. The rotation of the work piece is realized with the drive of the regulating wheel, and the grinding process is carried out with the driven grinding wheel. Due to this constructive design, there is no need for centers. The advantage of this method can be seen in that it is faster and more economical, particularly for large batch sizes. However, its disadvantages are the usually quite high tool costs and the fact that shafts are, under certain circumstances, no longer concentric to centers or bores, etc.

For example, the commercially available machine "Kronos L dual" by Mikrosa utilizes a technique that is also referred to as dual grinding. Dual grinding is a combination of the above-described methods. The shafts or parts are initially ground between centers. In this case, the work piece is driven by a work piece spindle and a work piece driver. The centricity therefore is ensured in this function "grinding between centers". Subsequently, the work piece is released from the centers and the centerless grinding process takes place in such a way that the work piece is driven by the regulating wheel and supported on each seat in order to achieve a stable behavior during the centerless grinding. This processing sequence is intended to ensure that the work piece center is not lost and the concentricity relative to the center is preserved. This method is particularly suitable for manufacturing long, narrow shafts because the errors caused by deflection can be better managed during the subsequent centerless grinding. In this case, it is disadvantageous that a work piece driver is still required and that the change-over between operating modes is relatively complicated.

U.S. Pat. No. 3,903,655 discloses a grinding machine with a "resilient" regulating wheel. This grinding machine features a drive for a grinding wheel and a drive for a regulating wheel, wherein the drive of the grinding wheel is apparently designed for a relatively high speed. A work piece is supported between the grinding wheel and the regulating wheel on a work piece axis, namely between centers or other suitable holding means. The driving axes of the grinding wheel and the regulating wheel and the work piece axis are aligned parallel. The grinding wheel, the regulating wheel and the work piece are mounted on separate carriages such that it is possible to adjust the distance between the work piece and the grinding wheel, as well as the distance between the work piece and the regulating wheel. The drive of the regulating wheel serves for driving the work piece by means of frictional forces. For this purpose, the regulating wheel is manufactured of a relatively hard yet "resilient" material. This means that the work piece rotates in a direction and with a speed that are defined by the regulating wheel. In this case, however, the regulating wheel of the grinding machine rotates with a relatively slow speed in comparison with the grinding wheel. This grinding machine is intended for the manufacture of precision machine components.

Although the grinding machine according to U.S. Pat. No. 3,903,655 utilizes certain elements that are also used in centerless grinding (e.g. driving the work piece via a regulating wheel), this machine is not designed for a flexibility that makes it possible to carry out "grinding between centers" as well as "centerless grinding", and the carriages for the grinding wheel, the regulating wheel and the work piece are all designed for realizing a precise and defined mechanical positioning. However, it is also mentioned that, in principle, not all three carriages need to be provided. The disclosure provides no detailed references as to the generation of a sufficient frictional force between the regulating wheel and the work piece such that it can be ensured that the work piece has and also maintains the required rotational speed during processing. The information provided with respect to the design and the function of the regulating wheel of a relatively hard but "resilient" material is merely of a general nature.

SUMMARY OF THE INVENTION

The invention is based on the objective of disclosing an improved grinding machine that combines the advantages of "grinding between centers" with those of "centerless grinding". The invention also aims to disclose a method that makes it possible to achieve greater flexibility and reliability in the manufacture of ground products.

In an inventive grinding machine, the drive of the regulating wheel not only serves for driving the work piece while grinding between centers, but also for driving the work piece during centerless grinding. In addition, a means is provided for measuring the contact pressure between the regulating wheel and the work piece while grinding between centers.

Due to the fact that the drive of the work piece is realized via the regulating wheel in both grinding modes, the work piece driver that would otherwise be required while grinding between centers can be eliminated. The rotational monitoring of the work piece is simplified and can also be automated since a means is provided for measuring the contact pressure between the regulating wheel and the work piece.

One also has, in principle, different options for realizing the independent adjustments of the grinding wheel and the regulating wheel relative to the work piece. It is possible to realize all of the three constructive variations described below:

a) the regulating wheel and the grinding wheel feature independent adjusting drives and a work piece support is arranged stationarily;

b) the grinding wheel and a work piece support feature independent adjusting drives and the regulating wheel is arranged stationarily;

c) the regulating wheel and a work piece support feature independent adjusting drives and the grinding wheel is arranged stationarily.

The respectively chosen design consequently also influences the sequence of processing steps to be observed for realizing a grinding process between centers. However, the desired handling advantages are also achieved during centerless grinding regardless of the chosen design; i.e. a third adjusting drive (as in U.S. Pat. No. 3,903,655) is not required in either operating mode.

A pressure sensor may be provided as the means for measuring the contact pressure of the regulating wheel on the work piece. The means for measuring the contact pressure of the regulating wheel on the work piece may also carry out a rotational monitoring of the work piece. When using a pressure sensor, it may be arranged on a footstock, on which the work piece is supported between centers. A piezo sensor known to a person skilled in the art may be used, for example, as pressure sensor, but the invention is not limited thereto. It would also be possible to use any other type of sensor such as, for example, and without limitation, strain gauges.

It is advantageous that the work piece support may also feature an arrangement of centers for simultaneously processing a number of work pieces with center pairs that are arranged behind one another or above one another or behind one another and above one another. This makes it possible to simultaneously process several work pieces. It goes without saying that the grinding machine also needs to be equipped with a corresponding number of grinding wheels and regulating wheels in this case, but the construction-related additional costs for the grinding machine can be maintained relatively low because no additional drives are required for the grinding wheel and the regulating wheel, as well as for adjusting the grinding wheel, the regulating wheel and the work piece support.

Due to its basically simple design, the inventive grinding machine can be easily changed over from grinding work pieces between centers to centerless grinding (or vice versa). Only the work piece support or the holder for the work piece needs to be exchanged in this case. The former can be realized, for example, by designing the work piece support such that it can be displaced in the direction of the work piece axis, wherein the latter can be realized, for example, by means of suitable auxiliary mechanisms on the work piece support itself. The respectively chosen design is, in principle, also not dependent on the three above-described basic constructive variations a-c of the grinding machine.

The inventive grinding machine is also suitable for use in different types of applications for the aforementioned reasons. The inventive grinding machine either can be used only for grinding between centers or only for centerless grinding. However, it is also possible to produce rough-ground work pieces by means of grinding between centers and to subsequently change the operating mode of the grinding machine in order to finish-grind the work pieces by means of centerless grinding.

The proposed machine design also provides a relatively high flexibility in the centerless grinding mode. For example, centerless grinding can either be carried out with a straight infeed or an angular infeed. The choice between these operating modes merely depends on whether the adjustment of the grinding wheel also allows a rotation of a grinding wheel about a vertical axis.

All in all, the basically simple design of the grinding machine in accordance with the invention makes it possible to achieve a versatility that could not be realized so far with conventional designs.

The invention is described in greater detail below with reference to the figures.

DESCRIPTION OF THE PREFERRED EMBODIMENTS

Figure 1:
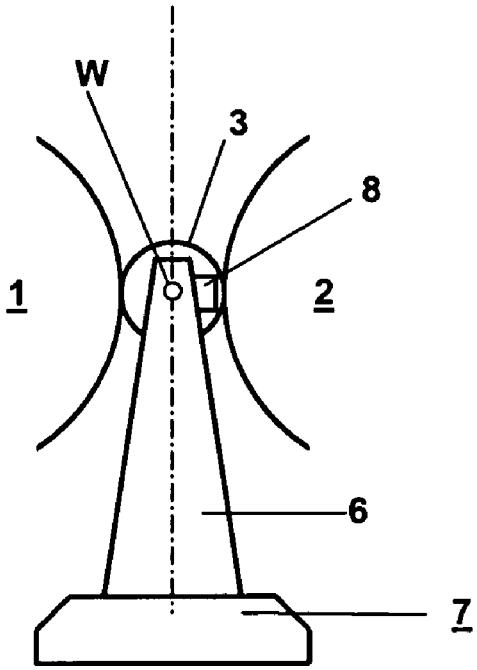
FIG. 1 is a schematic drawing of cylindrical grinding between centers with a grinding wheel and a regulating wheel.

FIG. 1 shows a schematic representation of a device for the cylindrical grinding between centers which features a grinding wheel 1 and a regulating wheel 2. In this case, a work piece 3 to be processed is accommodated between centers 4 (in this respect, see also FIG. 3). The centers 4 define a work piece axis W together with the work piece 3. The centers 4 are situated on a footstock 5 that is arranged on a holder 6 of a work piece support 7. During the operation, i.e. while carrying out a grinding process, the work piece 3 is driven by the rotating regulating wheel 2. The grinding process is carried out with the rotating grinding wheel 1. As mentioned above, the advantages of grinding between centers can be seen, in particular, in the centricity of all diameters ground on the work piece 3 referred to the work piece axis W.

In addition, a pressure sensor 8 is provided as a means for measuring the contact pressure of the regulating wheel 2 on the work piece 3. In this case, the (schematically illustrated) pressure sensor 8 is arranged on the footstock 5, on which the work piece 3 is supported between the centers 4. Although the pressure sensor 8 is preferably realized in the form of a piezo element, it is also possible to use other types of sensors or even other means for indirectly measuring the contact pressure (in this respect, see also the grinding methods described below).

Suitable adjusting means should be provided in order to move a work piece 3 into the working position illustrated in FIG. 1 so as to process the work piece by means of grinding between centers. This is described in greater detail below with reference to FIG. 4.

Figure 2:
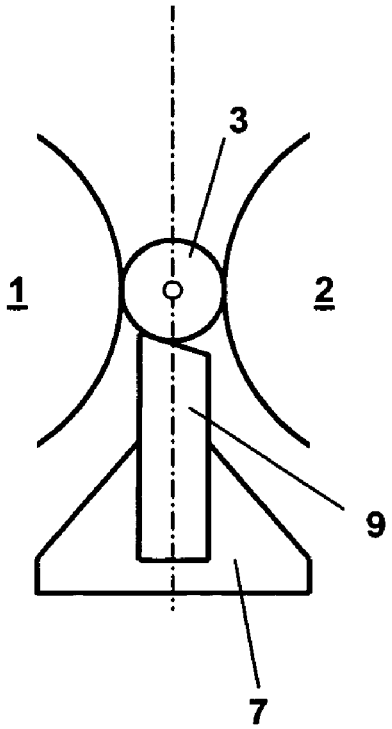
FIG. 2 is a schematic drawing of conventional centerless cylindrical grinding with a grinding wheel and a regulating wheel.

FIG. 2 shows a schematic representation of a device for the conventional centerless cylindrical grinding which features a grinding wheel 1 and a regulating wheel 2. In this case, the work piece 3 is merely placed onto a rest 9 that is arranged on the work piece support 7. The work piece 3 is also driven, i.e. set in rotation, by the regulating wheel 2 in this case. The grinding of the work piece 3 is carried out with the driven grinding wheel 1. The grinding wheel 1 and the regulating wheel 2 rotate with different speeds, wherein the rotational speed of the grinding wheel 1 is greater than the rotational speed of the regulating wheel although both wheels rotate in the same direction. It was already mentioned above that the advantages of this method can be seen, in particular, in the higher throughput rate because time-consuming clamping processes are eliminated. Centerless grinding therefore is particularly suitable for the manufacture of large batches of identically shaped work pieces.

Suitable adjusting means also should be provided in this case in order to move a work piece 3 into the working position illustrated in FIG. 2 so as to process the work piece by means of centerless grinding. In this respect, it would be possible, in principle, to utilize the same configuration of adjusting means as in the above-described grinding between centers.

Figure 3:
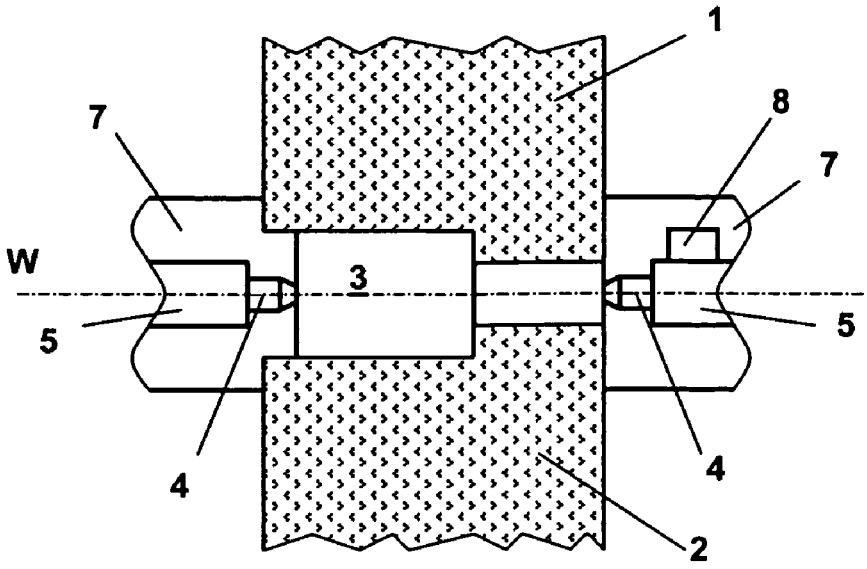
FIG. 3 is another drawing of cylindrical grinding between centers, wherein two different diameters are simultaneously ground on the work piece.

FIG. 3 shows another schematic representation for the cylindrical grinding between centers, wherein two different diameters are simultaneously ground on the work piece 3 in this case. Although this figure shows, in contrast to FIG. 1, a top view of the grinding configuration, we refer to the corresponding explanations in other respects.

Figure 4:
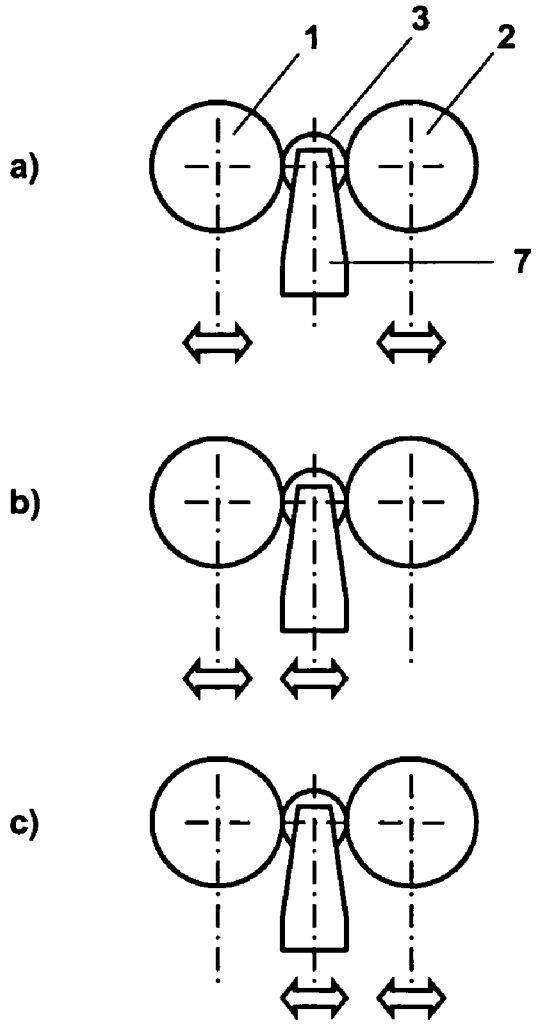
FIG. 4 is a schematic drawing of three constructive variations a-c of an inventive grinding machine.

FIG. 4 shows a schematic representation of three constructive variations a-c of an inventive grinding machine. The grinding wheel 1 and a regulating wheel 2 can be adjusted relative to the work piece independently of one another in all three constructive variations. In all three brief descriptions of the corresponding processing steps provided below, it is assumed that the grinding wheel 1, the work piece 3 and the regulating wheel 2 do not contact one another and are spaced apart from one another in a starting position. The possible movements of the respective adjusting devices are indicated with double arrows.

Constructive Variation a:

In constructive variation a, the regulating wheel 2 and the grinding wheel 1 feature independent (not-shown) adjusting drives and the work piece support 7 is arranged stationarily.

In this case, the method for grinding a work piece 3 between centers is carried out in such a way that

- the work piece 3 is supported on the footstock 5 between the centers 4,
- the rotating regulating wheel 2 is adjusted toward the work piece 3 until the means for measuring the contact pressure of the regulating wheel 2 on the work piece 3 registers a sufficient contact pressure for the grinding process between the regulating wheel 2 and the work piece 3, and
- the grinding wheel 1 is subsequently adjusted toward the work piece 3 and the work piece 3 is ground between the centers 4.

Constructive Variation b:

In constructive variation b, the grinding wheel 1 and the work piece support 7 feature independent (not-shown) adjusting drives and the regulating wheel 2 is arranged stationarily.

In this case, the method for grinding a work piece 3 between centers is carried out in such a way that

- the work piece 3 is supported on the footstock 5 between the centers 4,
- the work piece 3 is adjusted toward the rotating regulating wheel 2 until the means for measuring the contact pressure of the regulating wheel on the work piece 3 registers a sufficient contact pressure for the grinding process between the regulating wheel 2 and the work piece 3, and
- the grinding wheel 1 is subsequently adjusted toward the work piece 3 and the work piece 3 is ground between the centers 4.

Constructive Variation c:

In constructive variation c, the regulating wheel 2 and the work piece support 7 feature independent (not-shown) adjusting drives and the grinding wheel 1 is arranged stationarily.

In this case, the method for grinding a work piece 3 between centers is carried out in such a way that

- the work piece 3 is supported on the footstock 5 between the centers 4,
- the rotating regulating wheel 2 is adjusted toward the work piece 3 until the means for measuring the contact pressure of the regulating wheel on the work piece 3 registers a sufficient contact pressure for the grinding process between the regulating wheel 2 and the work piece 3, and
- the work piece 3 and the regulating wheel 2 are then (jointly) adjusted toward the grinding wheel 1 and the work piece 3 is ground between the centers 4.

It should be noted that only one means for measuring the contact pressure of the regulating wheel is used in all three described variations. It was already mentioned above that a sufficient contact pressure of the regulating wheel on the work piece can also be determined in an indirect fashion. For example, it is also possible to realize a rotational monitoring of the work piece 3 instead of providing a pressure sensor 8. As soon as or as long as the work piece 3 rotates with a sufficient speed, it can be assumed that a sufficient contact pressure is exerted. It goes without saying that a control or regulating device may be provided for this purpose. The grinding wheel 1 is not adjusted toward the work piece 3 in order to begin the grinding process until a desired nominal rotational speed of the work piece is reached.

In addition, all three procedural variations a-c also make it possible to rough-grind the work piece 3 between centers 4 and to finish-grind the work piece on the rest 9 by means of centerless grinding.

Figure 5:
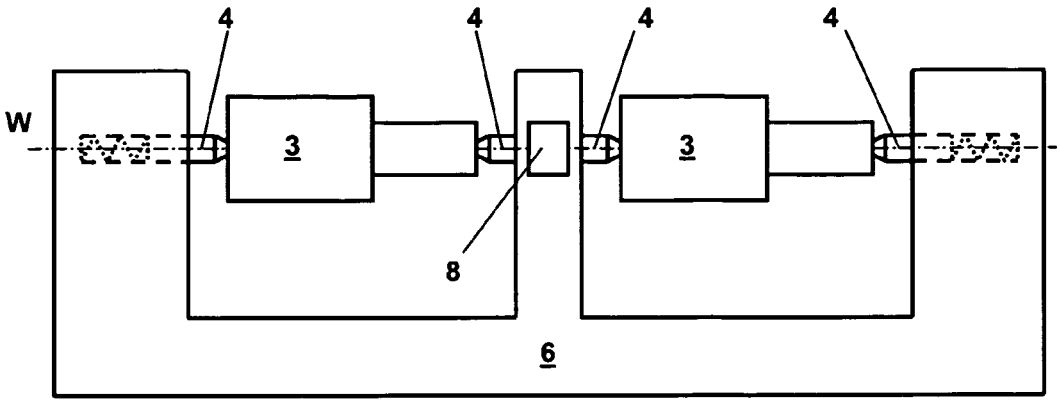
FIG. 5 is a schematic drawing of simultaneous processing of two work pieces by means of grinding between centers.
Figure 6:
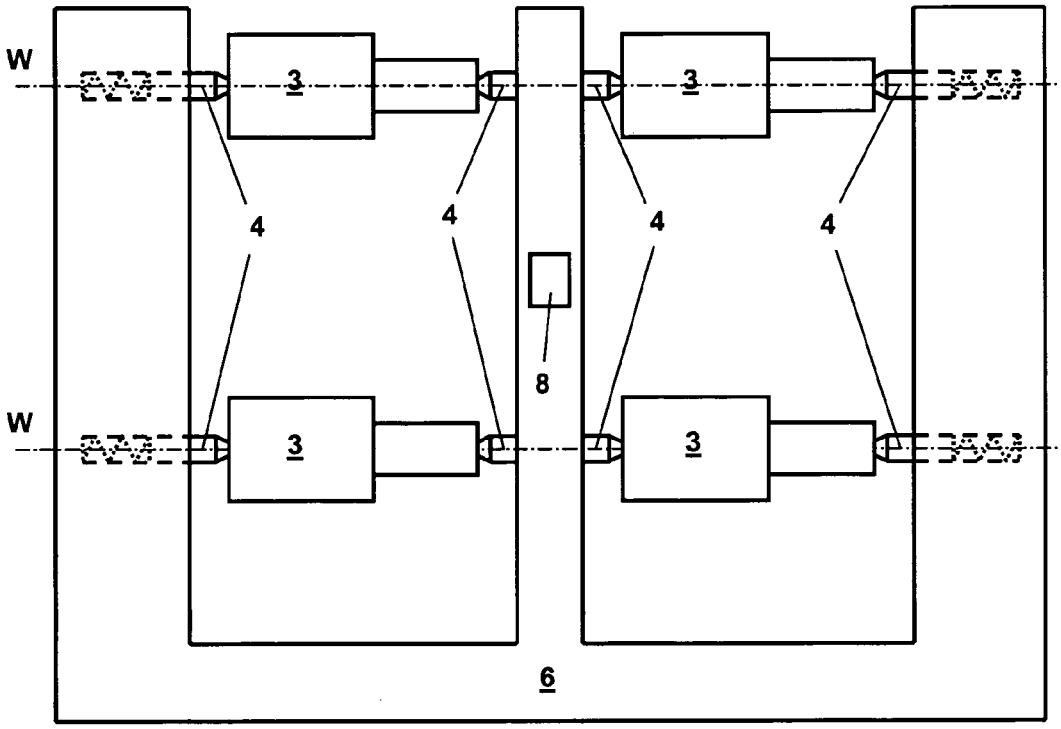
FIG. 6 is a schematic drawing of simultaneous processing of four work pieces by means of grinding between centers.

(Although not illustrated through-to-scale) FIGS. 5 and 6 show schematic representations for the simultaneous processing, for example, of two or four work pieces 3 by means of grinding between centers in accordance with FIGS. 1, 3 and 4. For example, it is possible to realize the work piece support 7 with the footstocks 5 in such a way that a number of work pieces 3 can be simultaneously held between centers 4 and processed in a footstock arrangement adjacent to one another or above one another or adjacent to one another and above one another. In the example of an adjacent footstock arrangement shown in FIG. 5, the grinding machine is only extended in the direction of the work piece axis W. No additional driving motors are required in adjacent footstock arrangements of this type because the respective grinding and regulating wheels 1 and 2 (that are not illustrated in order to provide a better overview) can be driven jointly and equiaxially.

If the footstocks are arranged above one another as shown in FIG. 6, the structural height (distance between the work piece axes W) needs to be adapted to the circumstances and the diameter of the respective grinding and regulating wheels 1 and 2, wherein an equiaxial drive can no longer be realized in this case. However, arrangements of this type may be very advantageous for the simultaneous manufacture of large numbers of precise work pieces because the production output can be multiplied with machines of extremely compact construction. Mechanisms that allow the finish-grinding of the work pieces 3 on rests 9 in the centerless mode and can be adjusted on demand can complicate the constructive design of the footstock arrangement. Although well-known to a person skilled in the art, these and other auxiliary means which are or may be required for the automated processing or finish-processing of the work pieces to be manufactured are not illustrated in these figures for reasons of simplicity.

In the illustrations shown in FIGS. 1-4, the driving axes of the grinding wheel 1, the regulating wheel 2 and the work piece 3 are aligned parallel. However, while grinding between centers and during centerless grinding, the driving axis of the grinding wheel 1 does not necessarily have to extend parallel to the work piece axis W. If the adjusting device for the grinding wheel is additionally provided with a device for realizing an incline of the grinding wheel axis, it is possible to operate with a straight infeed as well as with an angular infeed. The latter makes it possible to grind shoulders on the work piece.

Although basically known to a person skilled in the art as a constructive measure, FIGS. 5 and 6 do not show the option of providing the holder 6 with a device for pushing in a (not-shown) height-adjustable rest 9 for the centerless cylindrical grinding process, on which the work piece 3 can be supported for the further centerless grinding process once it is released from the centers 4. Such a rest 9 may be realized, for example, as shown in the schematic representation according to FIG. 2. Consequently, devices of this type would even make it possible to utilize a grinding machine designed in accordance with the invention for a partially or fully automated change-over between grinding between centers and centerless grinding.

The invention claimed is:

1. A grinding machine for grinding work pieces between centers, as well as for centerless grinding, comprising:

a grinding wheel;

a regulating wheel;

a drive for the grinding wheel;

a drive for the regulating wheel;

centers on a work piece axis; and a rest for centerless grinding;

wherein the work piece can be supported between the grinding wheel and the regulating wheel either between the centers or on the rest for centerless grinding, and wherein a driving axis of the regulating wheel and the work piece axis are parallel;

the grinding wheel and the regulating wheel can be adjusted relative to the work piece independently of one another; and the drive of the regulating wheel serves for driving the work piece while grinding between centers or for driving the work piece during centerless grinding;

the machine further comprising a means for measuring the contact pressure of the regulating wheel on the work piece for grinding between centers.

2. The grinding machine according to claim 1, further comprising a work piece support which supports the centers, wherein the grinding wheel and the regulating wheel can be adjusted relative to the work piece independently of one another by one of a, b or c defined below:

a) the regulating wheel and the grinding wheel feature independent adjusting drives and the work piece support is stationary;

b) the grinding wheel and the work piece support feature independent adjusting drives and the regulating wheel is stationary;

c) the regulating wheel and the work piece support feature independent adjusting drives and the grinding wheel is stationary.

3. The grinding machine according to claim 2, wherein the work piece support comprises a plurality of pairs of centers for simultaneously processing a plurality of work pieces.

4. A method for grinding a work piece between centers with a grinding machine according to claim 2, and according to subparagraph b of claim 2, the machine further comprising a footstock which supports the centers, the method comprising supporting the work piece on the footstock between the centers, adjusting the work piece toward the rotating regulating wheel until the means for measuring the contact pressure of the regulating wheel on the work piece registers a sufficient contact pressure for the grinding process between the regulating wheel and the work piece, and subsequently adjusting the grinding wheel toward the work piece and grinding the work piece between the centers.

5. A method for grinding a work piece between centers with a grinding machine according to claim 2, and according to subparagraph c of claim 2, the machine further comprising a footstock which supports the centers, the method comprising supporting the work piece on the footstock between the centers, adjusting the rotating regulating wheel toward the work piece until the means for measuring the contact pressure of the regulating wheel on the work piece registers a sufficient contact pressure for the grinding process between the regulating wheel and the work piece, and subsequently adjusting the work piece and the regulating wheel toward the grinding wheel and grinding the work piece between the centers.

6. The grinding machine according to claim 1, wherein the means for measuring the contact pressure of the regulating wheel on the work piece consists of a pressure sensor.

7. The grinding machine according to claim 6, further comprising a footstock which supports the centers, wherein the pressure sensor is disposed on the footstock.

8. The grinding machine according to claim 1, wherein the means for measuring the contact pressure of the regulating wheel on the work piece carries out a rotational monitoring of the work piece.

9. A method for grinding a work piece between centers with a grinding machine according to claim 2, and according to subparagraph a of claim 2, the machine further comprising a footstock which supports the centers, the method comprising supporting the work piece on the footstock between the centers, adjusting the rotating regulating wheel toward the work piece until the means for measuring the contact pressure of the regulating wheel on the work piece registers a sufficient contact pressure for the grinding process between the regulating wheel and the work piece, and subsequently adjusting the grinding wheel toward the work piece and grinding the work piece between the centers.

10. The method for grinding a work piece according to claim 9, further comprising rough-grinding the work piece between the centers and subsequently finish-grinding the work piece on the rest by means of centerless grinding.

11. A method for the centerless grinding of a work piece with a grinding machine according to claim 1, comprising:

placing the work piece onto the rest for centerless grinding, and subsequently grinding the work piece by means of centerless grinding, either with a straight infeed or an angular infeed.

12. A grinding machine for grinding work pieces between centers, as well as for centerless grinding, comprising:

a grinding wheel;

a regulating wheel;

a drive for the grinding wheel;

a drive for the regulating wheel;

a rest for centerless grinding;

a work piece support;

a holder disposed on the work piece support;

a footstock disposed on the holder;

a pair of centers disposed on the footstock and defining a work piece axis; and a sensor disposed on the footstock, for measuring the contact pressure of the regulating wheel on the work piece;

wherein at least the holder is exchangeable such that the work piece can be supported between the grinding wheel and the regulating wheel either on the rest for centerless grinding or between the centers; and wherein a driving axis of the regulating wheel and the work piece axis are parallel;

the grinding wheel and the regulating wheel can be adjusted relative to the work piece independently of one another; and the drive of the regulating wheel serves for driving the work piece while grinding between centers or for driving the work piece during centerless grinding.

13. A grinding machine for grinding work pieces between centers, as well as for centerless grinding, with a drive for a grinding wheel and a drive for a regulating wheel, wherein the work piece can be supported between the grinding wheel and the regulating wheel either between centers on a work piece axis or on a rest for centerless grinding, and wherein at least the driving axis of the regulating wheel and the work piece axis are aligned parallel and the grinding wheel and the regulating wheel can be adjusted relative to the work piece independently of one another, wherein the drive of the regulating wheel serves for driving the work piece while grinding between centers and for driving the work piece during centerless grinding, characterized in that a sensor for measuring the contact pressure of the regulating wheel on the work piece is arranged on a footstock, on which the work piece is supported between centers during grinding and which is arranged on a holder of a work piece support, wherein the work piece support or the holder is exchangeable.

* * * * *